US006579211B2

(12) United States Patent
Wu

(10) Patent No.: US 6,579,211 B2
(45) Date of Patent: Jun. 17, 2003

(54) TREADMILL WITH A SUPPORTING UNIT

(76) Inventor: Chieh-Ming Wu, No. 3, Alley 65, Lane 22, She-Tzu St., Shih-Lin Dist., Taipei City (TW)

( * ) Notice: Subject to any disclaimer, the term of this patent is extended or adjusted under 35 U.S.C. 154(b) by 143 days.

(21) Appl. No.: 09/903,618

(22) Filed: Jul. 13, 2001

(65) Prior Publication Data

US 2002/0147078 A1 Oct. 10, 2002

(30) Foreign Application Priority Data

Apr. 6, 2001 (TW) ..... 090205362

(51) Int. Cl.[7] ..... A63B 22/02
(52) U.S. Cl. ..... 482/54; 482/8
(58) Field of Search ..... 482/8, 54

(56) References Cited

U.S. PATENT DOCUMENTS 6,273,843 B1 * 8/2001 Lo ..... 482/54
6,325,745 B1 * 12/2001 Yu ..... 482/54
6,387,016 B1 * 5/2002 Lo ..... 482/54
6,461,275 B1 * 10/2002 Wang et al. ..... 482/8

OTHER PUBLICATIONS

Patent Application Publication US 2002/0183169 Chang, Mark, Jogging Machine.*

* cited by examiner

*Primary Examiner*—Nicholas D. Lucchesi
*Assistant Examiner*—Tam Nguyen
(74) *Attorney, Agent, or Firm*—Baker Botts L.L.P.

(57) ABSTRACT

A treadmill includes a base frame, a treadbase having a first crossbar, and a supporting unit. The supporting unit includes left and right rear legs pivoted to the base frame and the treadbase so as to permit the treadbase to be turnable relative to the base frame, a second crossbar interconnecting the left and right rear legs, and a hydraulic cylinder which has a cylinder body pivoted to the second crossbar, and a piston retractable from the cylinder body and connected to the first crossbar so that when the treadbase is turned to a folded position, the hydraulic cylinder pulls the left and right rear legs, which results in lifting of a front end of the treadbase.

3 Claims, 7 Drawing Sheets

TREADMILL WITH A SUPPORTING UNIT

CROSS-REFERENCE TO RELATED APPLICATION

This application claims priority of Taiwan patent Application No. 90205362, filed on Apr. 6, 2001.

BACKGROUND OF THE INVENTION

1. Field of the Invention

This invention relates to a treadmill that includes a treadbase and a supporting unit that supports the treadbase in a folded position.

2. Description of the Related Art

FIGS. 1 to 3 illustrate a conventional treadmill that includes a base frame 1, a treadbase 2 disposed above the base frame 1, and a supporting unit 3 disposed between the base frame 1 and the treadbase 2. The treadbase 2 is pivoted to the supporting unit 3 so as to be turnable about an axis between horizontal and folded positions relative to the base frame 1. The supporting unit 3 includes front and rear legs 103, 104 which are pivoted to the treadbase 2 via pivot pins that define the aforesaid axis. An inclination member includes a motor 303 mounted on a front end of the base frame 1, and an adjusting tubular member 4 which has a tubular sleeve 301 connected to the rear legs 104 and a screw rod 302 threadedly engaging the sleeve 301 and connected to the motor 303 so as to move the rear legs 104 toward the front legs 103 via movement of the sleeve 301, which, in turn, raises a front end of the treadbase 2 upwardly, thereby inclining the treadbase 2 relative to the base frame 1.

The conventional treadmill is disadvantageous in that in order to avoid interference with the base frame 1, the front end of the treadbase 2 has to be raised prior to the rotation of the treadbase 2 to the folded position, which results in inconvenience.

SUMMARY OF THE INVENTION

Therefore, it is an object of the present invention to provide a treadmill that is capable of overcoming the aforementioned drawbacks.

According to this invention, there is provided a treadmill that comprises: a base frame having front and rear ends; a treadbase disposed above the base frame, and having front and rear ends, left and right walls extending in a longitudinal direction from the front end to the rear end, and a first crossbar interconnecting the left and right walls; and a supporting unit that is disposed between the treadbase and the base frame and that includes spaced apart left and right rear legs which project upwardly and frontwardly from the rear end of the base frame to the treadbase and which have front ends pivoted to the front end of the treadbase anterior to the first crossbar so as to permit the treadbase to be turnable about a first axis that extends in a transverse direction relative to the longitudinal direction, and rear ends pivoted to the rear end of the base frame so as to permit the left and right rear legs to be turnable about a second axis that is parallel to the first axis, the treadbase being turnable about the first axis between a horizontal position, in which the treadbase lies on the base frame, and a folded position, in which the treadbase projects uprightly from the base frame, the supporting unit further including a second crossbar which interconnects the left and right rear legs and which is disposed between the first and second axes, and a hydraulic cylinder which includes a cylinder body pivoted to the second crossbar so as to permit the hydraulic cylinder to be turnable about a third axis that is parallel to the first axis, and a retractable piston projecting movably from the cylinder body and having a distal end which is distal from the cylinder body and which is connected to the first crossbar so that when the treadbase is turned from the horizontal position to the folded position, the piston of the hydraulic cylinder will be pulled to an extended state and the hydraulic cylinder will be turned so as to extend in a direction substantially perpendicular to the base frame in order to support the treadbase which leans inclinedly against the distal end of the piston of the hydraulic cylinder, and the left and right rear legs will be turned upwardly and rearwardly via pulling action of the hydraulic cylinder, which results in lifting of the first axis together with the front end of the treadbase that is turning toward the base frame.

BRIEF DESCRIPTION OF THE DRAWINGS

In drawings which illustrate embodiments of the invention.

DETAILED DESCRIPTION OF THE PREFERRED EMBODIMENTS

Figure 1:
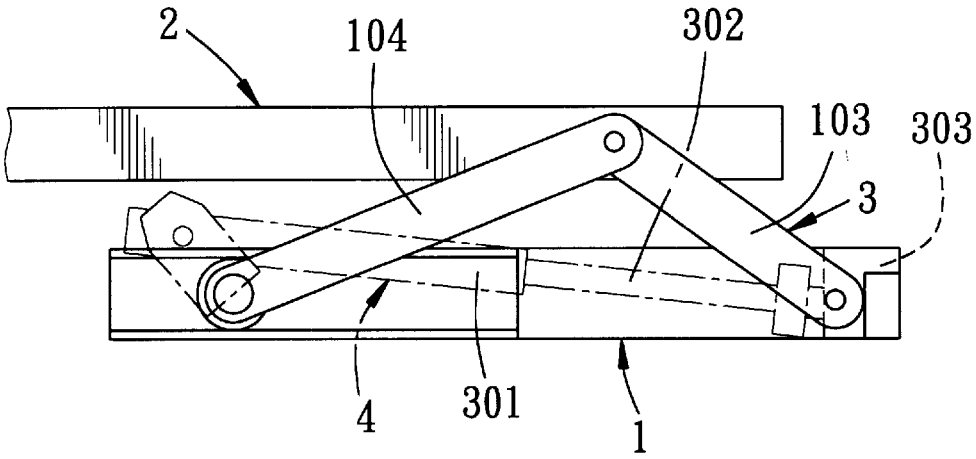
FIG. 1 PRIOR ART
FIG. 1 is a partly fragmentary side view of a conventional treadmill.
Figure 2:
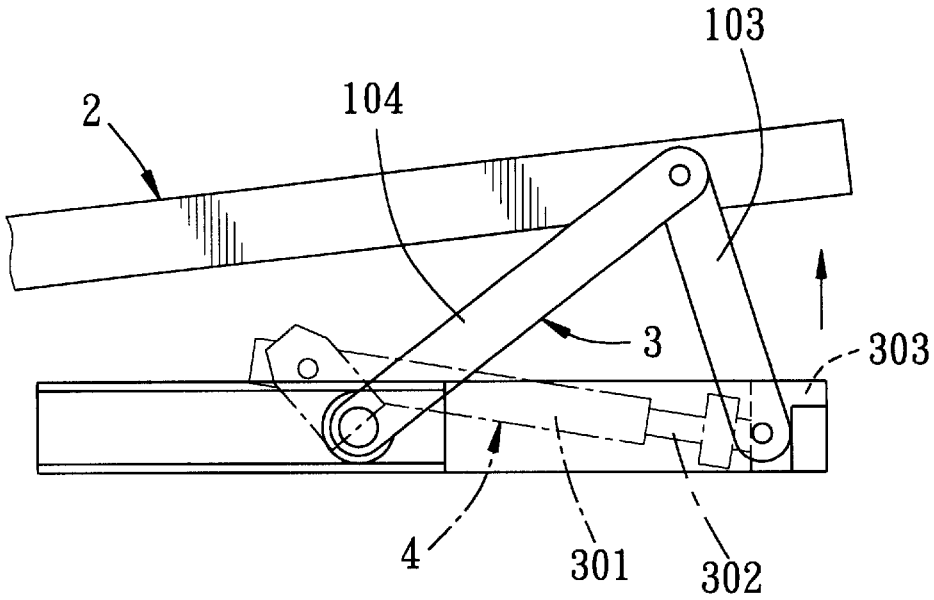
FIG. 2 PRIOR ART
FIGS. 2 and 3 illustrate lifting of a front end of a treadbase prior to rotation of the treadbase of the treadmill of FIG. 1 to a folded position.
Figure 3:
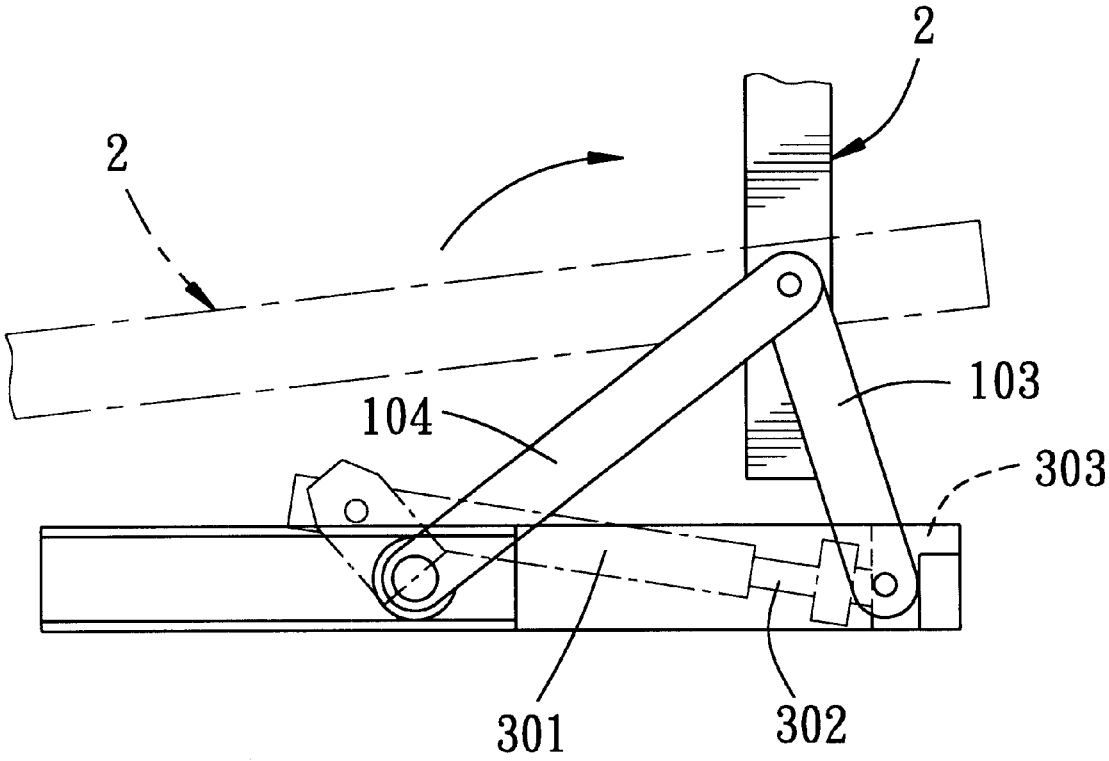
FIG. 3 PRIOR ART

FIGS. 4 to 7 illustrate a first preferred embodiment of a treadmill of this invention. The treadmill includes: a base frame 30 having front and rear ends 301, 302; a pair of upright posts 34 projecting uprightly from the front end 301 of the base frame 30, a treadbase 40 disposed above the base frame 30, and having a rotatable belt, front and rear ends 43, 44, left and right walls 41, 42 extending in a longitudinal direction from the front end 43 to the rear end 44, and a first crossbar 46 interconnecting the left and right walls 41, 42; and a supporting unit that is disposed between the treadbase 40 and the base frame 30 and that includes spaced apart left and right rear legs 33 which project upwardly and frontwardly from the rear end 302 of the base frame 30 to the treadbase 40 and which have front ends 332 pivoted to the front end 43 of the treadbase 40 anterior to the first crossbar 46 so as to permit the treadbase 40 to be turnable about a first axis (A) that extends in a transverse direction relative to the longitudinal direction, and rear ends 331 pivoted to the rear end 302 of the base frame 30 so as to permit the left and right rear legs 33 to be turnable about a second axis (B) that is parallel to the first axis (A). The treadbase 40 is turnable about the first axis (A) between a horizontal position, in which the treadbase 40 lies on the base frame 30 and is transverse to the posts 34 (see FIG. 5), and a folded position, in which the treadbase 40 projects uprightly from the base frame 30 (see FIGS. 4 and 6) and is substantially parallel to the posts 34. The supporting unit further includes a second crossbar 333 which interconnects the left and right rear legs 33 and which is disposed between the first and second axes (A, B), and a hydraulic cylinder 37 which includes a cylinder body 371 pivoted to the second crossbar 333 so as to permit the hydraulic cylinder 37 to be turnable about a third axis (C) that is parallel to the first axis (A), and a retractable piston 372 projecting movably from the cylinder body 371 and having a distal end 3721 which is distal from the cylinder body 371 and which is connected to the first crossbar 46 so that when the treadbase 40 is turned from the horizontal position to the folded position, the piston 371 of the hydraulic cylinder 37 will be pulled to an extended state and the hydraulic cylinder 37 will be turned so as to extend in a direction substantially perpendicular to the base frame 30 in order to support the treadbase 40 which leans inclinedly against the distal end 3721 of the piston 371 of the hydraulic cylinder 37 (see FIG. 6), and the left and right rear legs 33 will be turned upwardly and rearwardly via pulling action of the hydraulic cylinder 37, which results in lifting of the first axis (A) together with the front end 43 of the treadbase 40 when the latter is turning toward the base frame 30.

The base frame 30 includes left and right rail guides 35 extending in the longitudinal direction. The treadmill further includes left and right front legs 36 that extend upwardly from the base frame 30 to the treadbase 40 and that have rear ends 362 respectively pivoted to the left and right walls 41, 42 via a third crossbar 45 so as to permit the left and right front legs 36 to be turnable about a fourth axis (D) which is disposed between the first crossbar 46 and the first axis (A) and which is parallel to the first axis (A), and front ends 361 that are provided with rollers 363 which are slidable in the rail guides 35.

A stopper 38, which is in the form of a crossbar, spans the left and right guide rails 35 adjacent to the rear end 302 of the base frame 30 so as to prevent extra movement of the treadbase 40 upon moving to the folded position.

The treadmill of this invention can further include an inclination unit 50 which has a motor 53 fixed to the front end 43 of the treadbase 40, an inner threaded tubular sleeve 51 pivoted to the left and right front legs 36 via a fourth crossbar 364, and a screw rod that threadedly engages the sleeve 51 and that is driven by the motor 53 so that activation of the motor 53 results in raising and lowering of the front end 43 of the treadbase 40, thereby tilting the treadbase 40 to a desired angle relative to a ground level.

Figure 4:
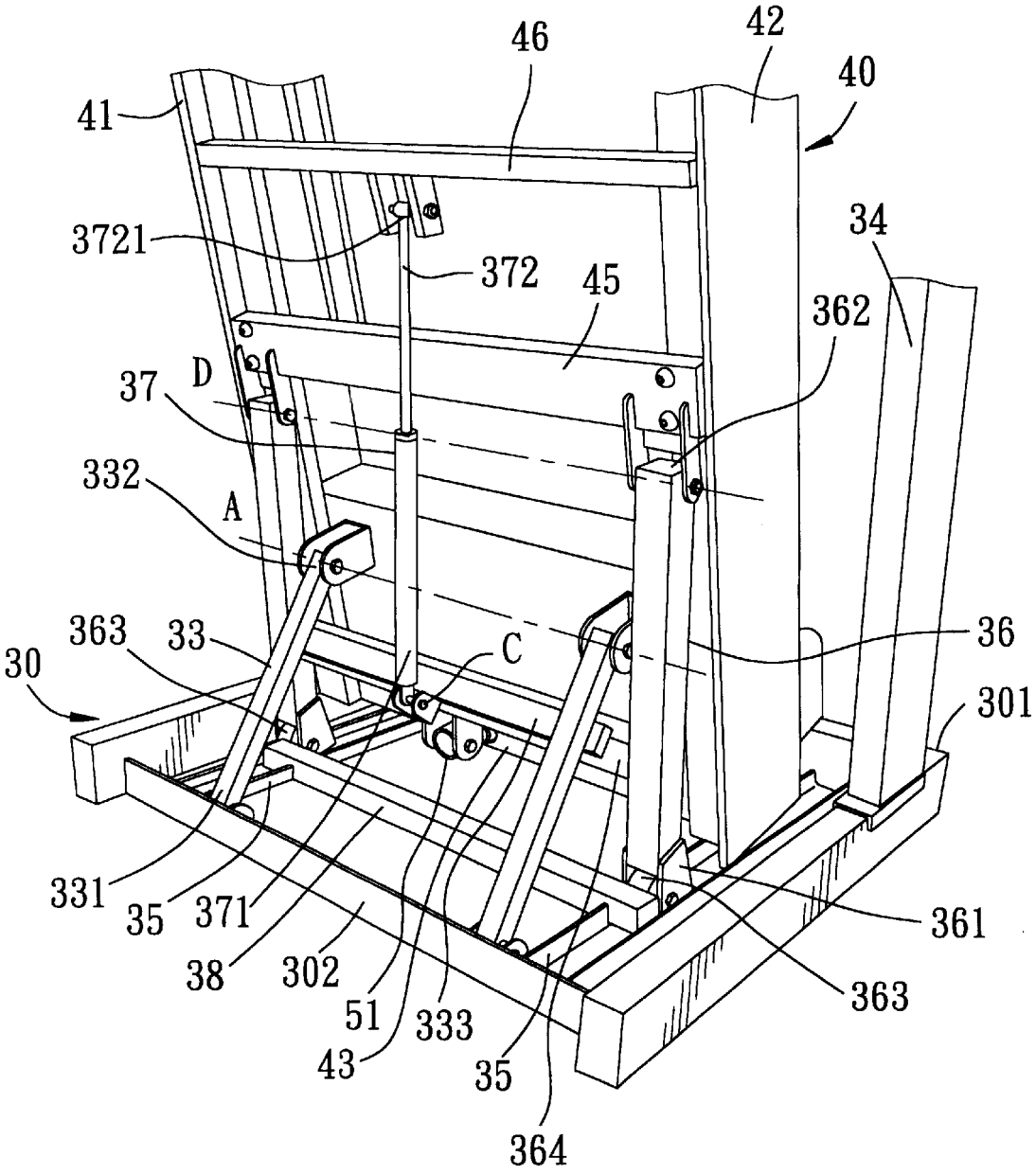
FIG. 4 is a fragmentary perspective view of a first embodiment of a treadmill of this invention.
Figure 5:
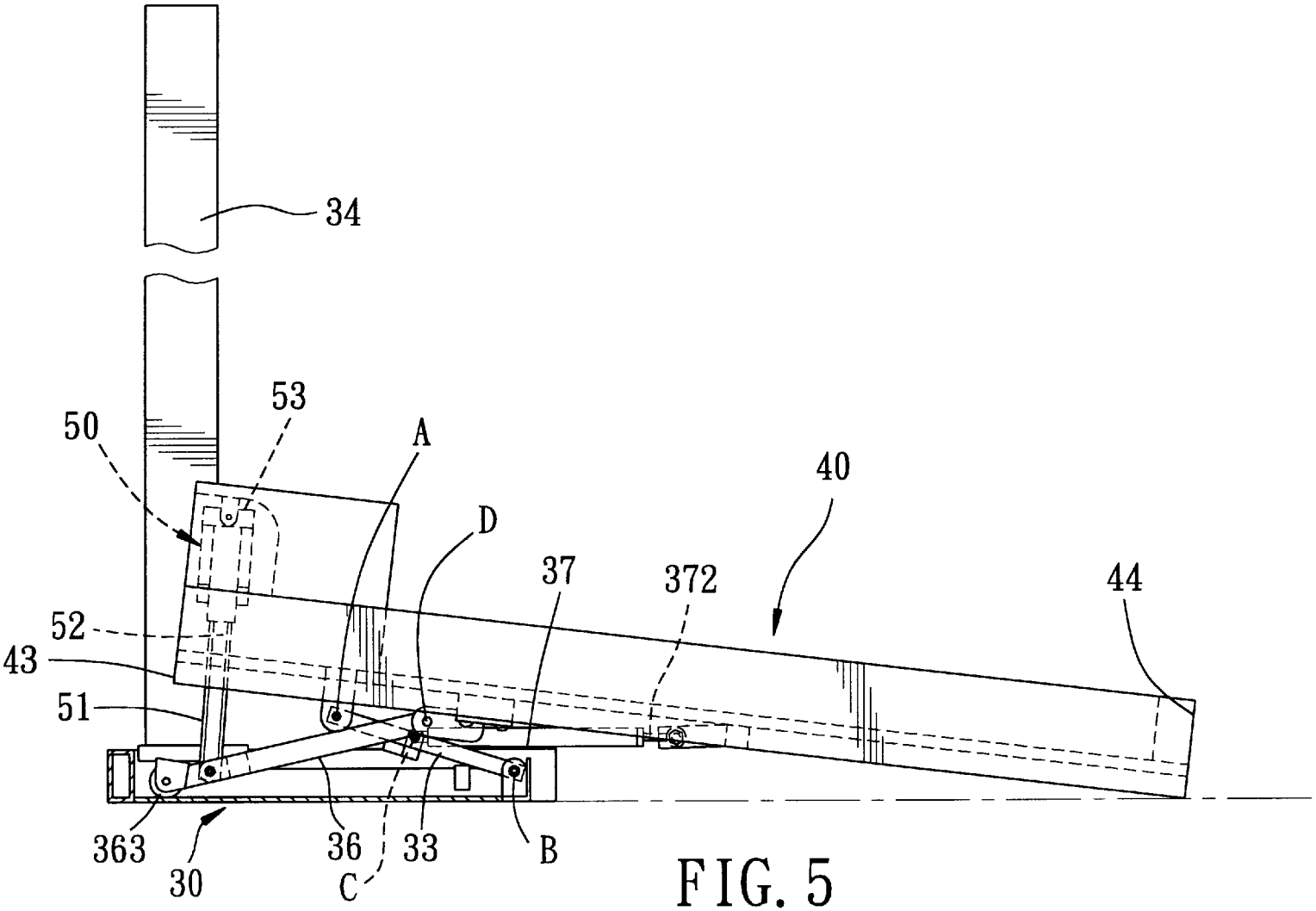
FIG. 5 is a side view of the treadmill of FIG. 4, illustrating a treadbase of the treadmill in a horizontal position.
Figure 6:
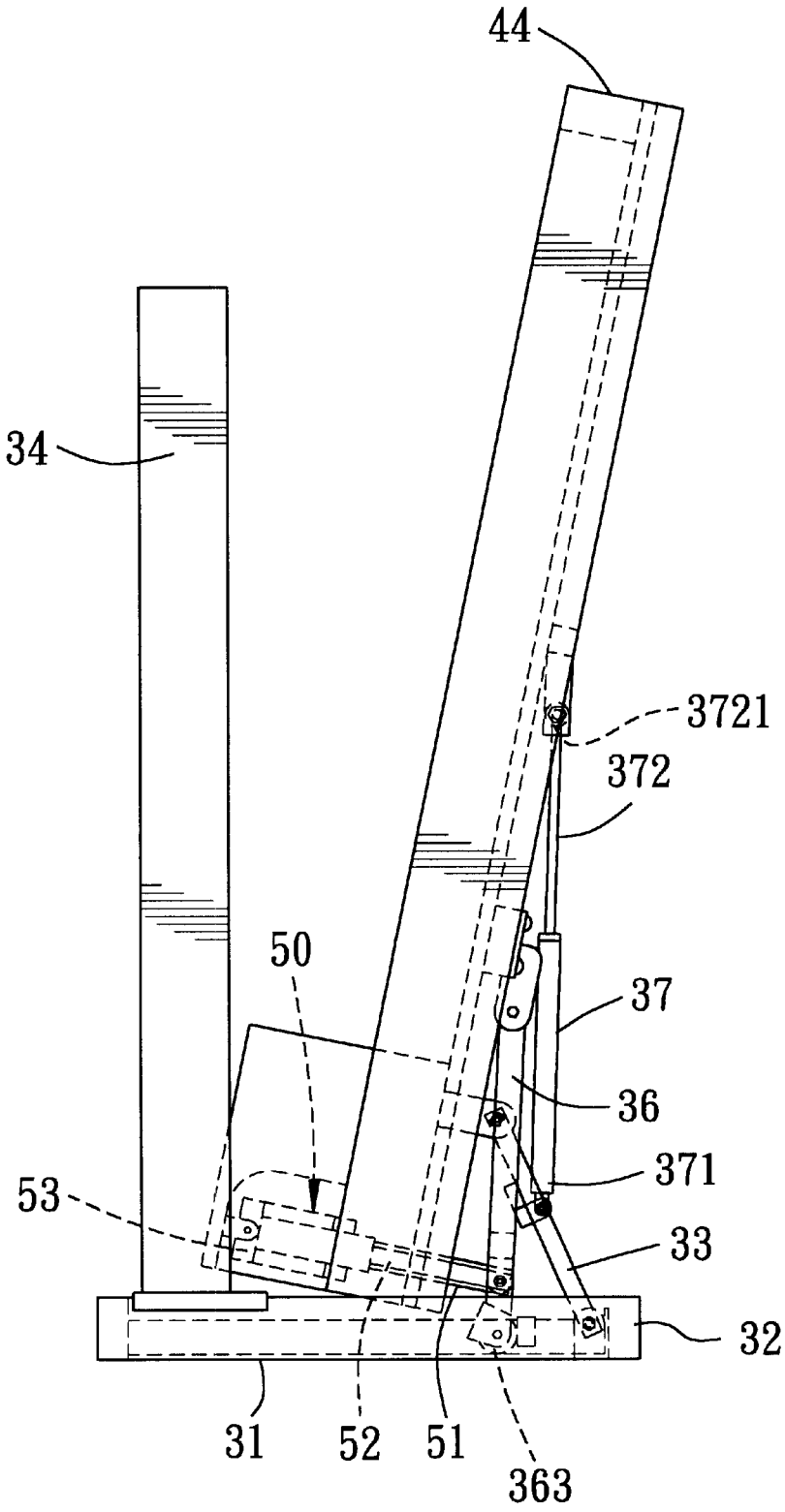
FIG. 6 is a side view of the treadmill of FIG. 4, illustrating a treadbase of the treadmill in a folded position.
Figure 7:
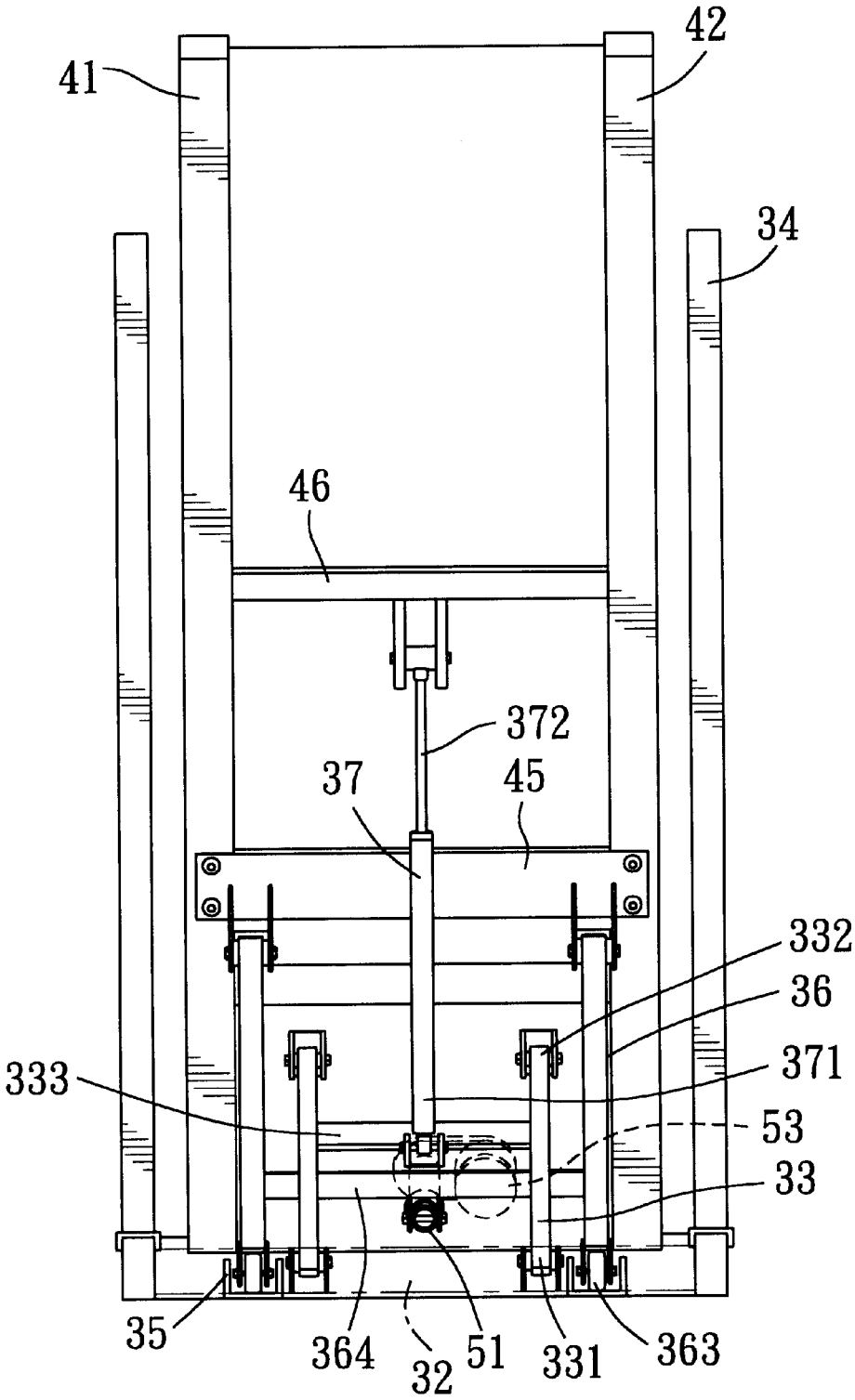
FIG. 7 is a bottom view of the treadmill of FIG. 4.
Figure 8:
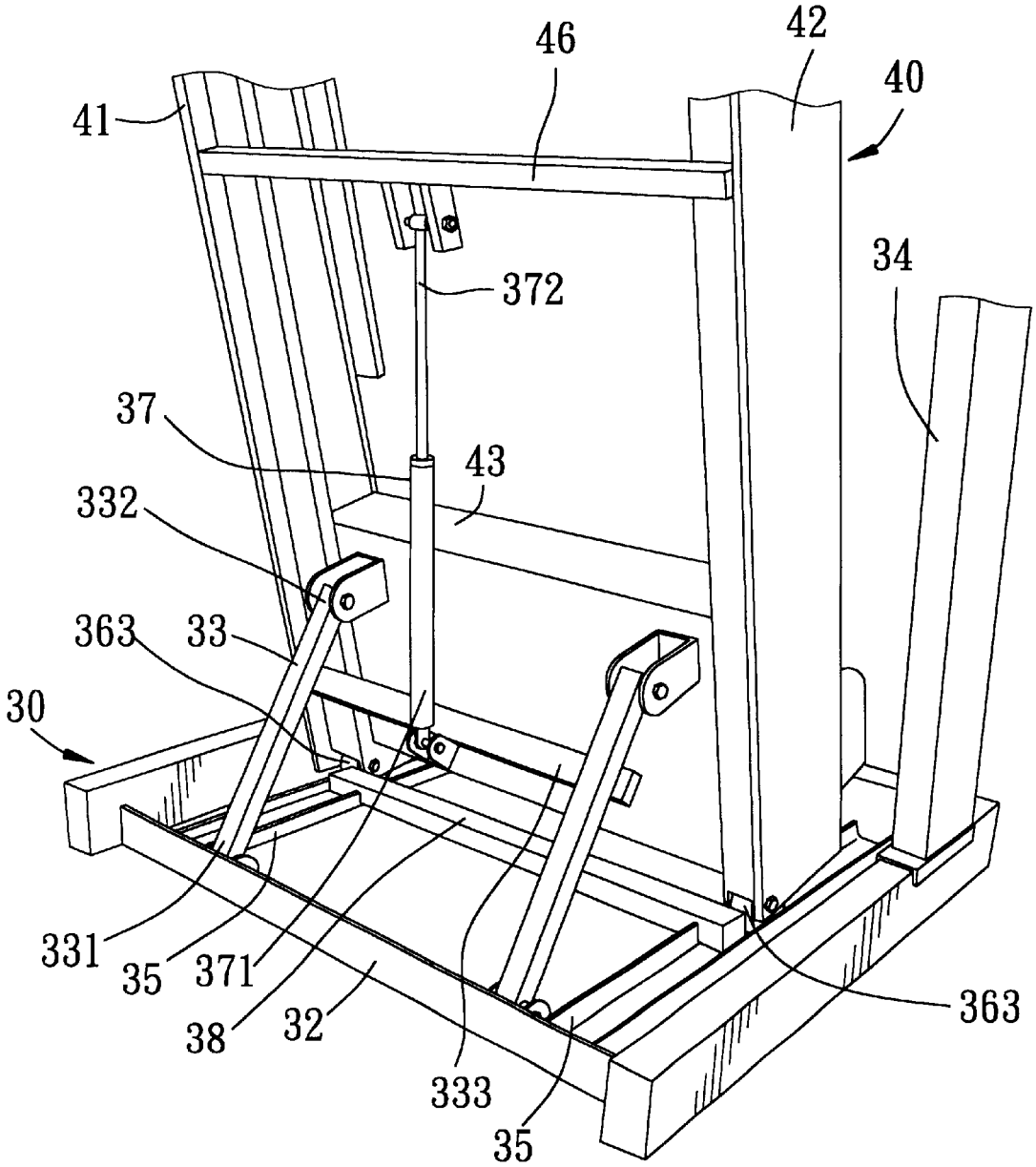
FIG. 8 is a fragmentary perspective view of a second embodiment of the treadmill of this invention.

FIG. 8 illustrates a second preferred embodiment of the treadmill of this invention modified from that shown in FIG. 4. The left and right front legs 36 are dispensed with in this embodiment, whereas the aforesaid rollers 363 are respectively provided on front ends of the left and right walls 41, 42 and are slidable in the rail guides 35 when the treadbase 40 moves from the horizontal position to the folded position.

With the design of the supporting unit of this invention, the drawbacks associated with the prior art can be eliminated.

With the invention thus explained, it is apparent that various modifications and variations can be made without departing from the spirit of the present invention.

I claim:

1. A treadmill, comprising:

a base frame having front and rear ends;

a treadbase disposed above said base frame, and having front and rear ends, left and right walls extending in a longitudinal direction from said front end to said rear end, and a first crossbar interconnecting said left and right walls; and a supporting unit that is disposed between said treadbase and said base frame and that includes spaced apart left and right rear legs which project upwardly and frontwardly from said rear end of said base frame to said treadbase and which have front ends pivoted to said front end of said treadbase anterior to said first crossbar so as to permit said treadbase to be turnable about a first axis that extends in a transverse direction relative to said longitudinal direction, and rear ends pivoted to said rear end of said base frame so as to permit said left and right rear legs to be turnable about a second axis that is parallel to said first axis, said treadbase being turnable about said first axis between a horizontal position, in which said treadbase lies on said base frame, and a folded position, in which said treadbase projects uprightly from said base frame, said supporting unit further including a second crossbar which interconnects said left and right rear legs and which is disposed between said first and second axes, and a hydraulic cylinder which includes a cylinder body pivoted to said second crossbar so as to permit said hydraulic cylinder to be turnable about a third axis that is parallel to said first axis, and a retractable piston projecting movably from said cylinder body and having a distal end which is distal from said cylinder body and which is connected to said first crossbar so that when said treadbase is turned from said horizontal position to said folded position, said piston of said hydraulic cylinder will be pulled to an extended state and said hydraulic cylinder will be turned so as to extend in a direction substantially perpendicular to said base frame in order to support said treadbase which leans inclinedly against said distal end of said piston of said hydraulic cylinder, and said left and right rear legs will be turned upwardly and rearwardly via pulling action of said hydraulic cylinder, which results in lifting of said first axis together with said front end of said treadbase that is turning toward said base frame.

2. The treadmill of claim 1, wherein said base frame includes left and right rail guides extending in said longitudinal direction, said treadmill further comprising left and right front legs that extend upwardly from said base frame to said treadbase and that have rear ends respectively pivoted to said left and right walls so as to permit said left and right front legs to be turnable about a fourth axis which is disposed between said first crossbar and said first axis and which is parallel to said first axis, and front ends that are provided with rollers which are slidable in said rail guides.

3. The treadmill of claim 1, wherein said base frame includes left and right rail guides extending in said longitudinal direction, said front end of said treadbase being provided with a pair of rollers that are slidable in said rail guides when said treadbase moves from said horizontal position to said folded position.

* * * * *